US009416468B2

(12) United States Patent
Bassi

(10) Patent No.: US 9,416,468 B2
(45) Date of Patent: Aug. 16, 2016

(54) METHOD FOR MANUFACTURING A WOVEN INFORMATIVE SUPPORT

(75) Inventor: Giglio Bassi, Carpi (IT)

(73) Assignee: TECNO LABEL S.R.L. CON SOCIO UNICO, Carpi (IT)

( * ) Notice: Subject to any disclaimer, the term of this patent is extended or adjusted under 35 U.S.C. 154(b) by 362 days.

(21) Appl. No.: 14/129,354

(22) PCT Filed: Apr. 6, 2012

(86) PCT No.: PCT/IB2012/051718

§ 371 (c)(1),
(2), (4) Date: Dec. 26, 2013

(87) PCT Pub. No.: WO2013/001380

PCT Pub. Date: Jan. 3, 2013

(65) Prior Publication Data

US 2014/0109362 A1 Apr. 24, 2014

(30) Foreign Application Priority Data

Jun. 27, 2011 (IT) ..... MO2011A0160

(51) Int. Cl.

| | |
|---|---|
| ***D03D 1/00*** | (2006.01) |
| ***D03D 13/00*** | (2006.01) |
| ***D03D 15/00*** | (2006.01) |
| ***G09F 3/02*** | (2006.01) |
| ***G09F 3/00*** | (2006.01) |

(52) U.S. Cl.

CPC ..... *D03D 1/0011* (2013.01); *D03D 13/004* (2013.01); *D03D 13/008* (2013.01); *D03D 15/00* (2013.01); *G09F 3/02* (2013.01); *G09F 3/0297* (2013.01); *D10B 2501/00* (2013.01)

(58) Field of Classification Search

CPC ... D03D 13/004; D03D 13/008; D03D 15/00; D03D 1/0011; D03D 3/00; D03D 3/005; G09F 3/02; G09F 3/0297

USPC ..... 28/140, 165

See application file for complete search history.

(56) References Cited

U.S. PATENT DOCUMENTS

| | | | | | |
|---|---|---|---|---|---|
| 3,744,035 | A | * | 7/1973 | Geirhos | D03C 19/00 139/319 |
| 5,824,393 | A | * | 10/1998 | Nakamura | D03D 1/0011 428/195.1 |
| 5,854,148 | A | * | 12/1998 | Asada | D06H 1/00 235/494 |
| 5,941,572 | A | * | 8/1999 | Gundjian | B41M 3/142 283/67 |
| 6,068,895 | A | * | 5/2000 | Kimura | D01F 1/10 428/29 |

(Continued)

FOREIGN PATENT DOCUMENTS

| | | | |
|---|---|---|---|
| EP | 919650 | A * | 6/1999 |
| JP | 2001146659 | A * | 5/2001 |
| JP | 2009161884 | | 7/2009 |

OTHER PUBLICATIONS

English language machine translation of JP 2009-161884 A (doc published Jul. 2009), 5 pages.*

*Primary Examiner* — Amy Vanatta

(74) *Attorney, Agent, or Firm* — Pearne & Gordon LLP

(57) ABSTRACT

The present invention concerns a method for manufacturing a woven informative support. The informative support (1) comprises a piece (2) of fabric, constituted by an interlacing of threads of at least two different colors. The interlacing of the threads of the piece (2) define the image (4) corresponding to an optically read code, on at least one face (3) thereof, through the contrast between at least two different colors.

8 Claims, 2 Drawing Sheets

(56) References Cited

U.S. PATENT DOCUMENTS 6,123,117 A * 9/2000 Borellini ..... D03D 1/0011 139/407
6,185,475 B1 * 2/2001 Chung ..... G06T 11/001 139/11
2004/0197535 A1 * 10/2004 Bleckmann ..... G08B 13/2434 428/195.1
2006/0070681 A1 * 4/2006 Haroutoonian ..... D03D 1/0011 139/383 R
2006/0135682 A1 * 6/2006 Offord ..... B41M 5/0041 524/556
2008/0308172 A1 * 12/2008 Terashima ..... D03D 1/00 139/420 R
2011/0033687 A1 * 2/2011 Deguchi ..... D03D 1/0041 428/219
2012/0164405 A1 * 6/2012 Webb ..... D03D 1/0011 428/196

* cited by examiner

METHOD FOR MANUFACTURING A WOVEN INFORMATIVE SUPPORT

TECHNICAL FIELD

The object of the present invention is a method for manufacturing a woven informative support, particularly for textile products for apparel and like products.

As is known, textile products, particularly apparel products, generally have one or more labels bearing symbols and information concerning the product to which they are affixed.

The principal aim is that of providing the consumer with a series of indications on the product regarding provenance, characteristics, care, data regarding the manufacturer, anti-counterfeiting sequential numbering and the like.

Generally, the known types of labels are made by means of printing on paper or fabric. One of the main drawbacks involved in utilizing these types of labels is that over time, the printing tends to deteriorate and fade.

In particular, fabric labels affixed to textile products undergo repeated washing, even at high temperatures, and repeated ironing processes.

This repeated washing accelerates discolouration of the printing on the label, making it difficult, if not impossible, to read it, resulting in the loss of the information printed thereon, while ironing may deform or shrink the label.

Another drawback of labels of this type is that they are generally affixed to the inside of the garments, and may thus be in contact with the skin of the wearer.

In these cases, the presence of the label can be cumbersome and irritating for the wearer, who is thus forced to cut it off, possibly saving it, but with the risk of confusing it afterwards with other labels from other textile products, or of losing it. Precisely with the aim of reducing bulk and thus the discomfort of the wearer, the dimensions of labels are limited and as a result, the amount of information that they can contain is limited.

The principal objective of the present invention is to solve the problems stated hereinabove, proposing a rapid and efficient method for manufacturing a woven informative support that makes it possible to obtain informative supports offering optimal readability of the information conveyed thereby, even after prolonged use.

One advantage of the above-mentioned method is that it makes it possible to obtain an informative support that is particularly comfortable for the wearer.

Another advantage of the above-mentioned method is that it makes it possible to obtain an informative support that is suitable for supplying a large amount of information.

Another advantage of the above-mentioned method is that it makes it possible to manufacture an informative support that is of small dimensions.

Further characteristics and advantages of the method according to the present invention will emerge more fully from the description of a preferred, but not exclusive, embodiment of the method itself, with reference to the accompanying drawings, wherein.

With particular reference to these figures, (1) indicates an informative support as a whole, particularly for textile products. The informative support (1) comprises a piece (2) of fabric, constituted by an interlacing of threads of at least two different colours. Through the contrast between threads of at least two different colours, the interlacing of threads of the piece (2) defines an image (4) that comprises a QR code (5).

As is known, this code is substantially a set of data that are stored optically by means of an image constituted by the contrast between alternating graphic symbols arranged in such a manner as to define a figure that can be read automatically by a special device such as a scanning sensor and decoded, so as to retrieve the information contained therein.

The QR Code, an acronym for Quick Response, is a particular type of optically read code, consisting of modules arranged within a square-shaped pattern. This type of matrix code allows for the storage of a greater amount of data compared to other optically read codes, such as bar codes for example, and others of a different nature. In fact, the QR code also allows for storage of digital matter, such as links to Internet navigation pages, video clips, audio files, which, owing to their nature, cannot be set out in writing. Furthermore, it does not require costly apparatuses in order to be read, but it can be decoded using a camera on a cellular telephone that is equipped with a specific reader programme (QR code reader).

The informative support (1) obtained by the method according to the present invention is substantially a piece of fabric. As is known, the interlacing of the warp threads with the weft thread defines the weave. The warp threads (horizontal with reference to the figures) are divided into sets. By opening the sets, a gap (shed) is obtained, through which the weft thread (vertical with reference to the figures) is inserted; with the exchange of positions of the sets, an interlacing is obtained that locks the weft thread in place, resulting in the construction of the fabric.

The method according to the present invention comprises the following steps.

Figure 1:
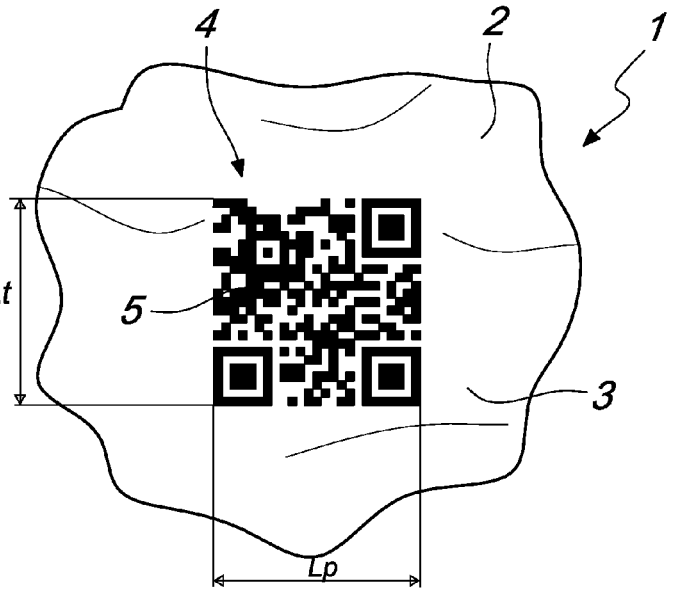
FIG. 1 is a front view of the informative support according to the invention.

The method initially provides for choosing the height (Lt) of the QR code. The height (Lt) of the QR code is the crosswise dimension with respect to the direction of the warp threads, as shown in FIG. 1. The QR code also has a width (Lp) understood as the dimension that is perpendicular to the height (Lt). The QR code must be of a substantially square shape and consequently it is necessary that the height and width be substantially equal.

The method further provides for choosing a total number of pixels per side (Px) of the QR code (5). As is known, in a QR code, 21 is the minimum number of pixels per side. The minimum number of pixels per side can be increased by 4 in 4 pixels, as relates to the amount of information one desires to insert in the QR code.

The method further provides for choosing a loom with a certain number of warp threads per centimeter (Or/cm) ranging from 100 to 160, and for supplying this loom with a number of weft threads per centimeter (Tr/cm), in at least two colours, ranging from 60 to 120 of each colour. As regards the number of warp threads per centimeter, a preferred loom for the execution of the method has 114 to 120 threads. Alternatively, a loom particularly suited to the aim, has 155 threads.

The method then provides for the interweaving, by means of the loom, of the weft threads and the warp threads, so as to obtain, by means of the contrast between the two colours of the weft threads, an image (4) that comprises the QR code (5).

The method then provides for subjecting the informative support to a heating stage at a temperature ranging from 180° C. to 220° C. Preferably, this stage is carried out by means of calendering.

The heating stage between 180° C. and 220° C. makes it possible to compact and stabilize the fabric so that it will not undergo substantial deformation even after washing or subsequent pressing.

Preferably, the choice of the number of weft threads per centimeter provides for choosing a number of wefts per pixel (Tr/Px) within the range of 2 to 10. The loom is therefore supplied with a number of weft threads per centimeter (Tr/cm), in at least two colours, as obtained by the relation $$\frac{Tr}{\text{cm}} = \left(\frac{Tr}{Px} \times \frac{Px}{Lt}\right) \times R,$$

where R is a compensation factor within the range of 0.93 to 0.98.

The numbers of weft and warp threads established on the basis of the method according to the present invention makes it possible to obtain a QR code (5) that is well defined and thus clearly readable. In particular, the compensation factor R, which reduces the nominal number of weft threads per centimeter, makes it possible to obtain from the loom a QR code (5) whose width (Lp) is greater than the height (Lt). Increased owing to the compensation factor (R) utilized for the calculation of the number of weft threads per centimeter, the width of the QR code (5) is substantially reduced to the required value following the heating stage between 180° C. and 220° C. In fact, this stage determines a compaction of the weft threads and the warp threads, which leads to a reduction of the width of the informative support and of the QR code (5), so that the height and the width of the QR code are substantially equal. The heating stage between 180° C. and 220° C. thus permits further stabilization of the thread fibres. In particular, the calendering stage is very advantageous for polyester threads, in that it produces a partial heat setting of the fibres, which become markedly stable.

Owing to the application of the method according to the present invention, the QR code (5) remains clearly legible even after washing many times. In addition to being very stable, the informative support obtained by the method according to the present invention also offers the advantage that any shrinkage that it might undergo is substantially identical in the direction of the weft threads and in the direction of the warp threads. This means that even in the case of shrinkage, the QR code (5) remains perfectly legible in any case.

The interlacing, or weave, of the weft threads and the warp threads, is preferably a satin 16 on the QR code (5) and a satin 8 on the back, with a density of the weft threads (Tr/cm) ranging from 80 to 120. As an alternative, the interlacing of weft threads and the warp threads could be a satin 8 on both sides with a density of the weft threads (Tr/cm) ranging from 80 to 120, or a satin 5 on one side and a satin 10 on the other side, with a density of the weft threads (Tr/cm) ranging from 60 to 80. The types of weaves cited above increase the compactness, the stability and the definition of the QR code (5).

Preferably, the threads are multifilament yarns made of a polymeric material, particularly polyester. The uniqueness of the polyester is that the colouring, which this type of material undergoes, is indelible, and in particular, it does not deteriorate or undergo loss of colour after repeated washing, even at high temperatures. In fact, the processes of colouring and possible decolouration of the polyester yarn are carried out at extremely high temperatures, definitely higher than those that might be reached during use and the washing of a textile product carried out in the home.

More specifically, the weft and warp threads have a thread count, defined as the ratio of the weight of the yarn to the length, in the range of 6 to 110 Decitex. The preferred value of this ratio ranges from 30 Decitex to 50 Decitex.

Preferably, the piece of fabric (2) has a weft density (Tr/cm), defined as the number of weft threads per cm, in the range of 60 to 120 threads per colour. The weft threads preferably have a thickness in a range of 20 to 110 Decitex and a number of twists ranging from 120 to 150 turns.

The density of the warp threads (Or/cm), defined as the number of warp threads per centimeter, preferably ranges from 100 to 160. Examples of looms that are particularly suited to the purpose have 114 or 155 threads. The warp threads preferably have a thickness ranging from 30 to 50 Decitex and a number of twists equal to about 1000 turns.

By varying the thread count values and the weft density, it is possible to obtain weaves with different properties. For example, by reducing the thread count of the warp threads, it is possible to make the piece (2) of fabric lighter in weight and softer. A weft density (Tr/cm) ranging from 80 to 120 threads per colour makes it possible to obtain an image of high quality and that with proper definition, even when much reduced in size.

Figure 3:
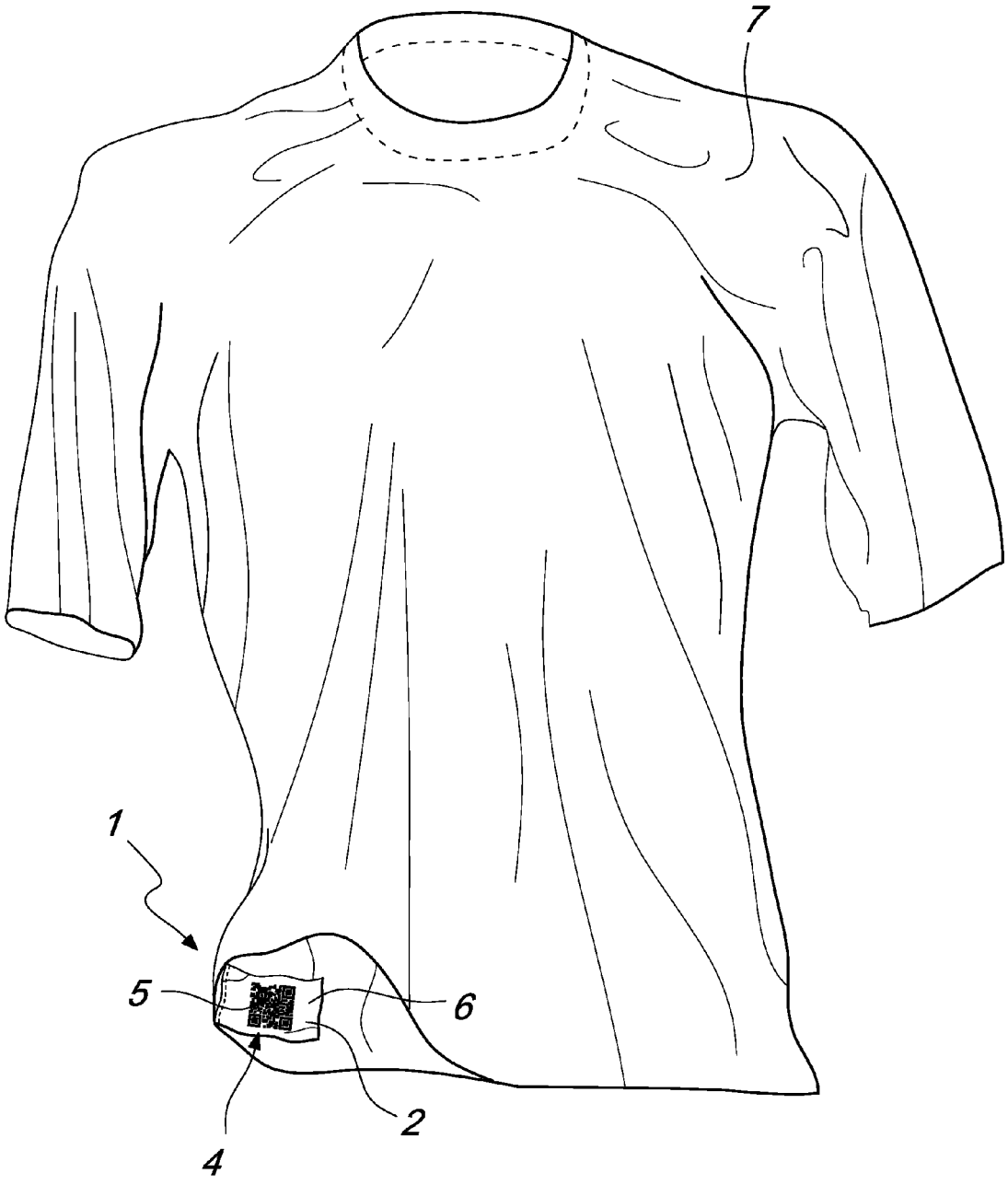
FIG. 3 is a front view of a second possible embodiment of the support according to the invention.

The method according to the present invention thus permits the manufacturing of an informative support in the form of a piece (2) of fabric, as shown in FIG. 3. The piece (2) of fabric can be used as an informative label (6) to be affixed to a product (7), for example to a garment. By means of the QR code (5), the label (6) is able to convey a plurality of information about the product (7), for example information concerning product care (instructions pertaining to washing, ironing, drying or other matters), product identification information (which is useful for verifying product authenticity), and sales, advertising or other types of information.

Figure 2:
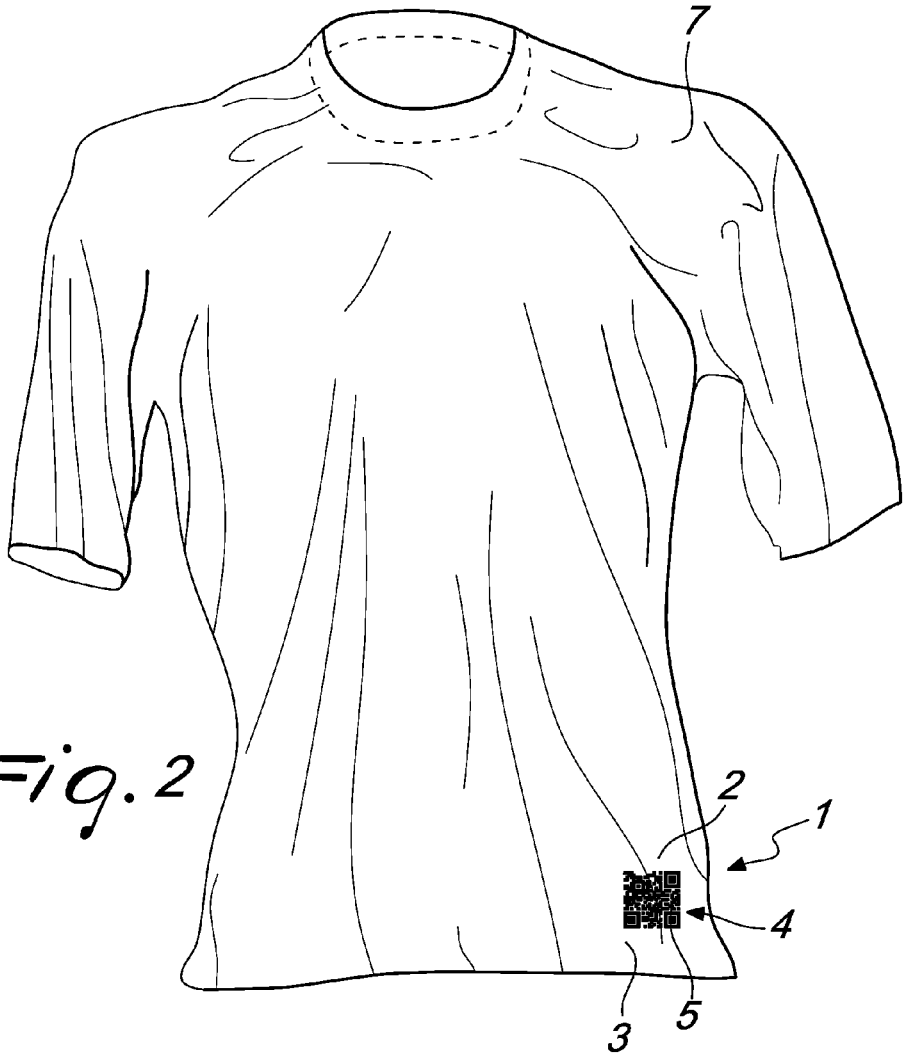
FIG. 2 is a front view of a first possible embodiment of the support according to the invention.

Advantageously, in the case in which the product (7) to which the support (1) is to be affixed, is a garment, the piece (2) of fabric may consist of a portion, preferably on the perimeter, of the garment itself, as shown in FIG. 2, or a label fixed to the inside thereof, as in FIG. 3.

In this manner, it is possible to read the information stored in the QR code (5), by pointing the camera of a cellular phone (or another type of reader) equipped with the suitable reader programme at the image, ensuring that the entire image is included. Once the reading begins, the information stored in the QR code (5) appears directly on the cellular phone screen.

The informative support (1) according to the present invention does not undergo changes with the passing of time, in particular owing to the fact that the QR code (5) is created by the interlacing of weft and warp threads, the colouring of which is substantially indelible, unlike the colouring obtained by printing. This prevents deterioration, discolouration or damage even after repeated washing of the QR code (5).

Furthermore, the possibility of incorporating the informative support (1) directly in the product (7), as shown in FIG. 2, makes it possible to eliminate the discomfort created by the presence of normal labels available on the market. Alternatively, should the solution appearing in FIG. 3 be adopted, the label can be also be made in small dimensions, keeping the quality of the QR code (5) unaltered, owing to the manufacturing of a piece of fabric (2) with a high density of weft and warp threads. Even though they supply a great amount of information, these limited dimensions do not cause discomfort for the wearer.

Additionally, the possibility of conveying information with a QR code (5) of small dimensions makes it possible to propose along with the same support (1) (for example a label for garments) further images or drawings as well (for example the designer's signature and sequential numbering). Moreover, the uniqueness of being highly resistant over time is a further guarantee of the quality and the preservation thereof even after prolonged use.

The invention claimed is:

1. A method for manufacturing a woven informative support provided with a QR code, comprising the following steps:

choosing the height (Lt) of the QR code (5);

choosing a total number of pixels (Px) per side of the QR code;

choosing a loom with a certain number of warp threads per centimeter (Or/cm) ranging from 100 to 160;

supplying a loom with a number of weft threads per centimeter (Tr/cm), in at least two colours, ranging from 60 to 120 per colour;

interweaving, by means of said loom, of the weft threads and the warp threads, so as to obtain, by means of the contrast between the two colours of the weft threads, an image (4) that comprises the QR code;

subjecting the informative support to a heating stage at a temperature ranging from 180° C. to 220° C., wherein the stage of supplying a loom with a number of weft threads per centimeter (Tr/cm), in at least two colours, ranging from 60 to 120 per colour, comprises the following stages:

choosing a number of wefts per pixel (Tr/Px), ranging from 2 to 10;

supplying a loom with a number of weft threads per centimeter (Tr/cm), in at least two colours, as obtained by the relation $$\frac{Tr}{\text{cm}} = \left(\frac{Tr}{Px} \times \frac{Px}{Lt}\right) \times R,$$

wherein R is a compensation factor within the range of 0.93 to 0.98.

2. The method according to claim 1, wherein the heating stage at a temperature between 180° C. and 220° C. is carried out by means of calendering.

3. The method according to claim 1, wherein the interweaving carried out by means of said loom is a satin 16 on the QR code (5) and a satin 8 on the back of the QR code (5), with a number of weft threads per centimeter (Tr/cm) ranging from 80 to 120 per colour.

4. The method according to claim 1, wherein the interweaving carried out by means of said loom is a satin 8 on both sides, with a number of weft threads per centimeter (Tr/cm) ranging from 80 to 120 per colour, or a satin 5 on one side and a satin 10 on the other side, with a number of weft threads per centimeter (Tr/cm) ranging from 60 to 80 per colour.

5. The method according to claim 1, wherein said weft and warp threads have a ratio of the weight of the yarn to the length, in the range of 20 to 110 Decitex.

6. The method according to claim 1, wherein said weft and warp threads are made of a material selected from the group consisting of synthetic and polymeric fibres.

7. The method according to claim 1, wherein said weft and warp threads are multifilament threads and made of a polymeric material.

8. The method according to claim 1, wherein said weft and warp threads are multifilament threads and made of a polyester material.

* * * * *